US008632418B2

(12) United States Patent
Sato

(10) Patent No.: US 8,632,418 B2
(45) **Date of Patent: *Jan. 21, 2014**

(54) GOLF CLUB

(75) Inventor: Fumiaki Sato, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 257 days.

This patent is subject to a terminal disclaimer.

(21) Appl. No.: 13/110,964

(22) Filed: May 19, 2011

(65) Prior Publication Data

US 2011/0287853 A1 Nov. 24, 2011

(30) Foreign Application Priority Data

May 21, 2010 (JP) ..... 2010-117439

(51) Int. Cl.
*A63B 53/02* (2006.01)

(52) U.S. Cl.
USPC ..... 473/307; 473/288; 473/309

(58) Field of Classification Search
USPC ..... 473/288, 296, 298–299, 307, 310, 473/244–248, 309
See application file for complete search history.

(56) References Cited

U.S. PATENT DOCUMENTS

| | | | | |
|---|---|---|---|---|
| 3,897,058 | A * | 7/1975 | Koch | 473/206 |
| 5,951,411 | A * | 9/1999 | Wood et al. | 473/307 |
| 6,620,054 | B2 * | 9/2003 | Tseng | 473/306 |
| 7,083,529 | B2 * | 8/2006 | Cackett et al. | 473/309 |
| 7,883,430 | B2 * | 2/2011 | Thomas et al. | 473/307 |
| 2002/0037773 | A1 * | 3/2002 | Wood et al. | 473/246 |

FOREIGN PATENT DOCUMENTS

| | | | | |
|---|---|---|---|---|
| JP | 2005270402 | * | 10/2005 | |
| JP | 2005270402 | A * | 10/2005 | A63B 53/02 |
| JP | 2010-057554 | A | 3/2010 | |

* cited by examiner

*Primary Examiner* — Stephen L. Blau
(74) *Attorney, Agent, or Firm* — Sughrue Mion, PLLC

(57) ABSTRACT

A golf club includes: a shaft; a head including a hosel formed with a hosel hole; a shaft case with a substantially tube shape being bonded to a leading end of the shaft, the shaft case being inserted into the hosel hole, the shaft case being fixed to the hosel by a ring-shaped screw member fitted onto an upper portion of the shaft case and detachably screwed into a female screw in an inner circumferential surface of the hosel hole, wherein an outer side surface of a lower side part of the shaft case and a lower side part of the hosel hole have non-circular cross-section shapes.

9 Claims, 11 Drawing Sheets

GOLF CLUB

BACKGROUND

1. Field of the Invention

The present invention relates to a golf club, and particularly to a golf club with a shaft which can be easily replaced.

2. Description of the Related Art

A golf club is made by attaching a head to the leading end side of a shaft. The shaft is provided with a grip attached to the base end portion thereof.

According to a conventional general golf club head, a hosel hole is directly provided in the head, and the shaft is inserted into the hosel hole and bonded by adhesive. In addition, an epoxy adhesive is generally used as the adhesive. When the shaft is replaced, the shaft can be pulled out by heating the hosel portion and destroying the composition of epoxy resin hardener.

JP-A-2010-57554 discloses a golf club with a head attached to the leading end of the shaft, in which a substantially cylindrical shaft case is bonded to the leading end of the shaft, the shaft case is inserted into the hosel from the upper end side of the hosel in the head, and the shaft case is fixed to the hosel by a ring-shaped screw member which is fitted onto the shaft case and detachably screwed into the upper end side of the hosel. The shaft case disclosed in this patent document has a configuration in which only the leading end portion is sharpened to have a V shape and further to the upper side than the leading end portion of the shaft case has a cylindrical shape with a true circle shaped cross-section.

SUMMARY

An object of the present invention is to make it possible to strongly fix a shaft case to a head in a golf club in which the shaft case is bonded to the leading end of a shaft and the shaft case is detachably attached via a screw member as the golf club disclosed in Japanese Unexamined Patent Application No. 2010-57554.

According to an aspect of the invention, there is provided a golf club including: a shaft; a head including a hosel formed with a hosel hole; a shaft case with a substantially tube shape being bonded to a leading end of the shaft, the shaft case being inserted into the hosel hole, the shaft case being fixed to the hosel by a ring-shaped screw member fitted onto an upper portion of the shaft case and detachably screwed into a female screw in an inner circumferential surface of the hosel hole, wherein an outer side surface of a lower side part of the shaft case and a lower side part of the hosel hole have non-circular cross-section shapes.

The non-circular cross-section shapes may be square shapes.

The female screw of the hosel hole may be provided further to a lower part than the upper end of the hosel hole by a predetermined distance.

The golf club may further include: a male screw provided on an outer circumferential surface of the upper end portion of the shaft case; a nut member screwed onto the male screw; and a ring-shaped spacer interposed between the nut member and the screw member, the ring-shaped spacer being provided with a cut portion extending from the inner circumference to the outer circumference.

According to the golf club of the present invention, it is possible to pull out the shaft case from the hosel by loosening the screw member and unscrewing the screw member from the hosel. The shaft can be replaced by inserting a new shaft case and shaft connected body, which is obtained by attaching a shaft case to a shaft in advance, into the hosel and screwing the screw member.

According to the present invention, since the side outer surface of the lower side portion of the shaft case and the lower side portion of the hosel hole respectively have a non-circular cross-section shape, rotation of the shaft case about the axis center of the hosel hole is prevented and the shaft case is strongly attached by causing these non-circular cross-section shape portions to be engaged with each other.

The screw member can be easily screwed since the lower side portion of the screw member is firstly inserted into the hosel hole and made to be in a standing state when the screw member is attached to the hosel hole, by providing the female screw of the hosel hole at a lower position with respect to the upper end of the hosel hole by a predetermined distance, and then the screw member is screwed while rotated.

If a nut member is, screwed onto the upper end portion of the shaft case, and a spacer is made to be interposed between the nut member and the screw member, the sliding resistance at the time of rotating the screw member is lowered, and thereby the screw member can be easily rotated. Since the space does not vibrate at the time of a shot and is slidably fixed if a cut portion ranging from the inner circumference to the outer circumference is provided in this space, it is possible to prevent the screw member from being caught by the nut member when the screw member is rotated in the loosening direction and the nut member is pressed upward, and to thereby easily rotate the screw member.

BRIEF DESCRIPTION OF THE DRAWINGS

The present invention will become more fully understood from the detailed description given hereinbelow and the accompanying drawing which is given by way of illustration only, and thus is not limitative of the present invention and wherein.

DETAILED DESCRIPTION OF THE INVENTION

Hereinafter, description will be made of an embodiment with reference to the drawings.

Figure 1:
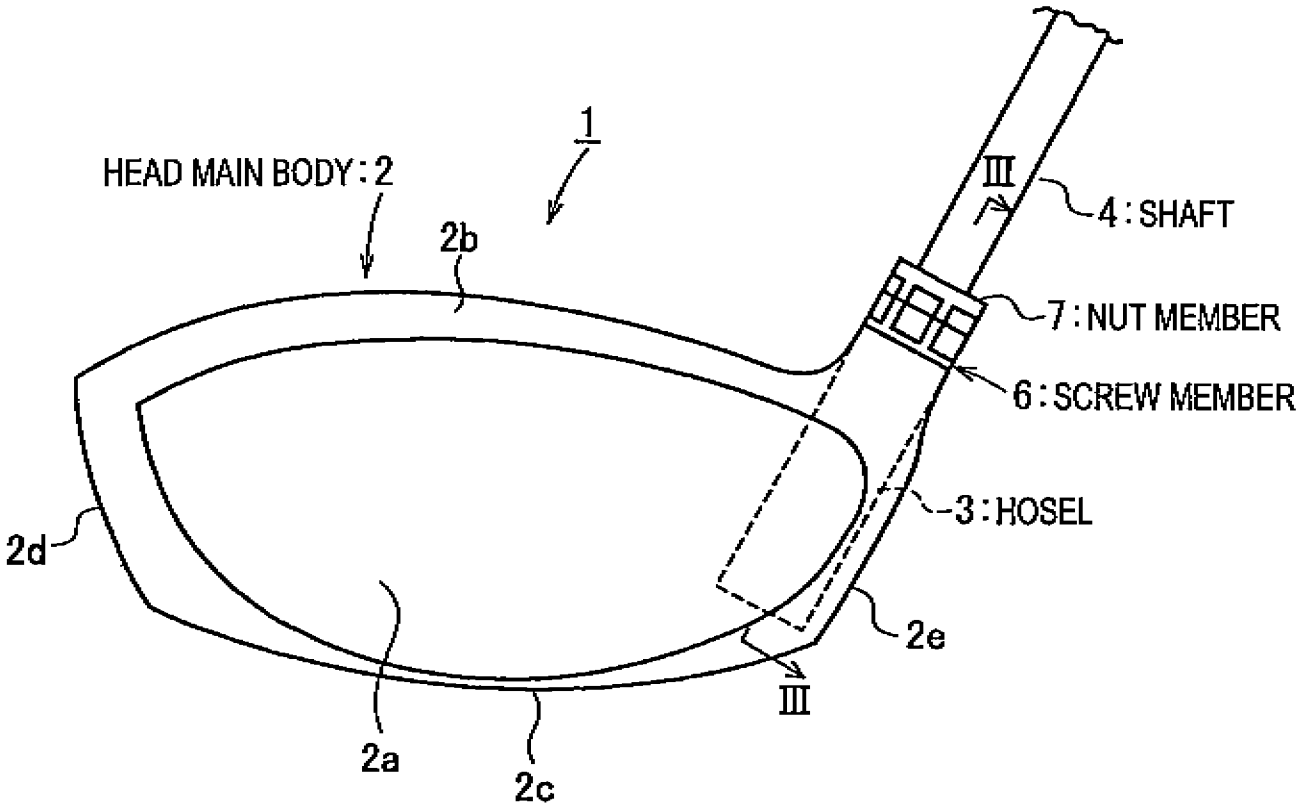
FIG. 1 is a front view of a head according to an embodiment.
Figure 2:
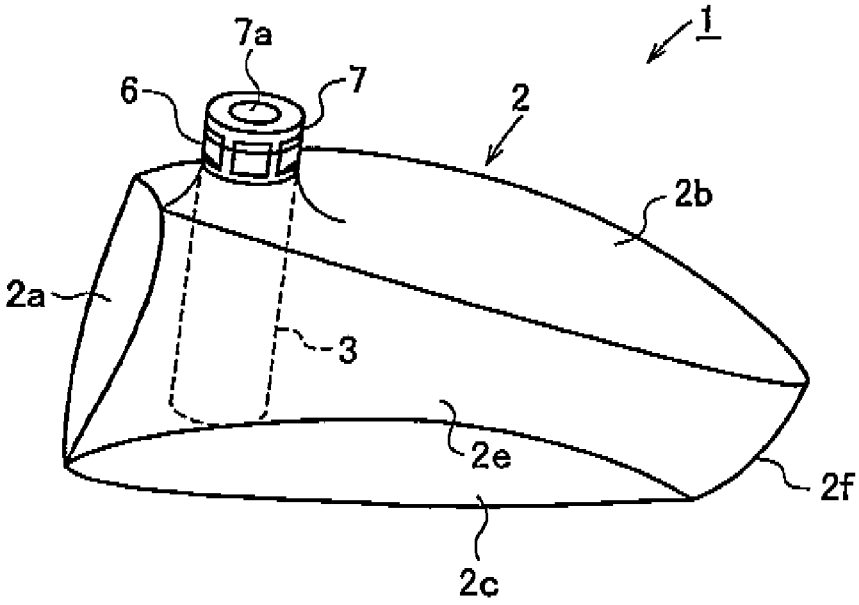
FIG. 2 is a side view of the head on the heel side.

FIG. 1 is a front view of a head of a golf club according to an embodiment, and FIG. 2 is a side view of the head of the golf club on the heel side. As shown in FIGS. 1 and 2, this golf club is obtained by attaching a shaft 4 to a hosel 3 in a head 1 via a shaft case 5 and a screw member 6 and attaching a nut member 7 to the upper end portion of the hosel 3.

This head 1 includes a head main body 2 and the hosel 3 attached to the head main body 2. This head 1 is a hollow wood type and includes a face portion 2*a*, crown portion 2*b*, a sole portion 2*c*, a toe portion 2*d*, a heel portion 2*e*, and back portion 2*f*.

Figure 3:
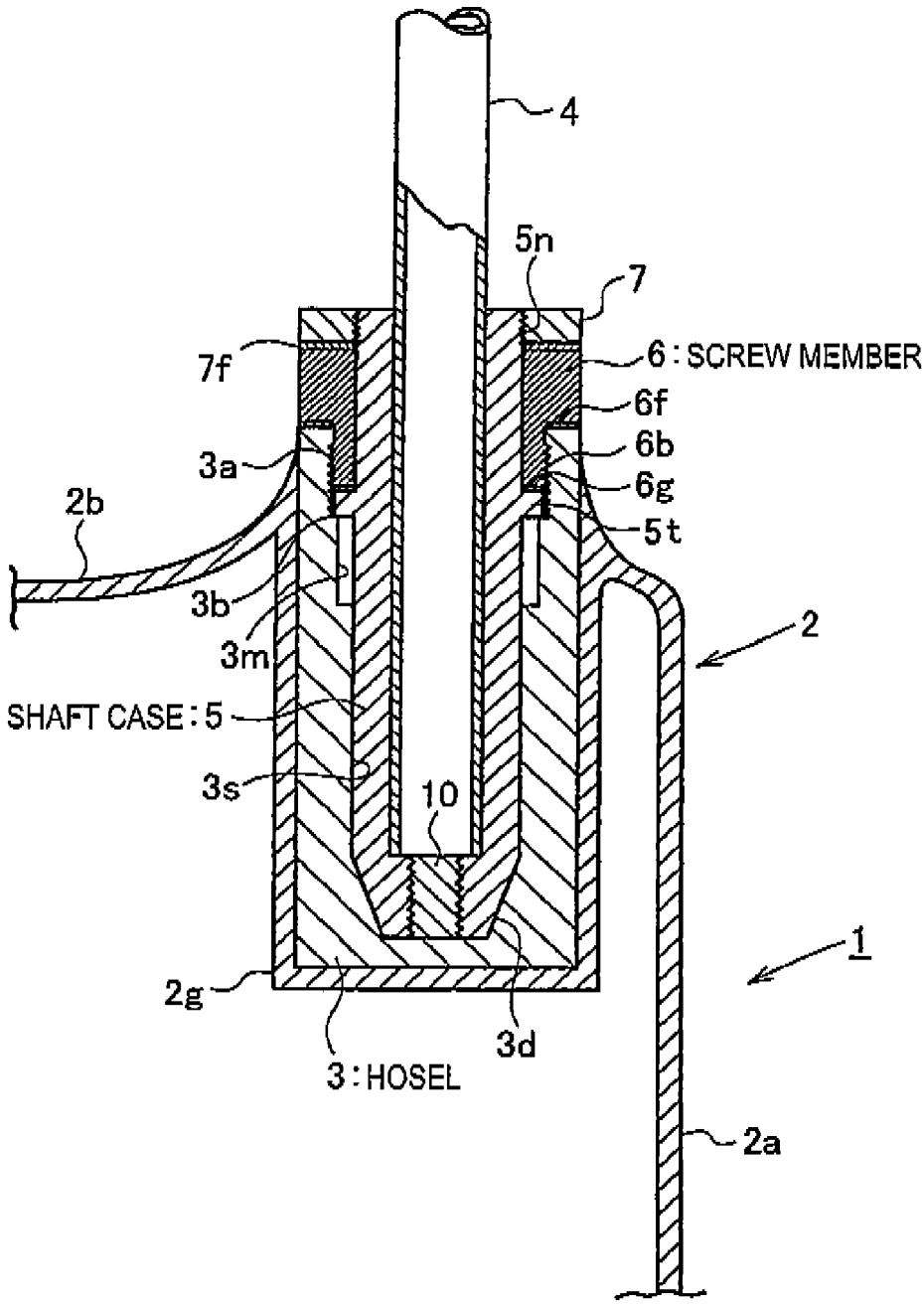
FIG. 3 is a cross-sectional view taken along the III-III line in FIG. 1.

As shown in FIG. 3, a cylindrical hosel placement portion 2*g* is provided on the heel portion 2*e* side and the face portion 2*a* side of the crown portion 2*b*. This hosel placement portion 2*g* has a cylindrical shape with an opened upper end and a closed lower end and extends in a coaxial state with the shaft 4. The hosel 3 is inserted into this hosel placement portion 2*g* from the upper direction and bonded by appropriate bonding means such as welding, brazing, adhering, shrink-fitting, cool-fitting, or the like. In addition, the hosel may be integrally formed with the head main body. For example, the hosel may be integrally produced with the head main body by casting and processing with a CNC processor in order to enhance its dimensional accuracy.

As shown in FIGS. 4 to 8, the hosel 3 has a substantially cylindrical shape which is obtained by piercing a hole from the upper end to the lower end in the axial center line direction.

Figure 6:
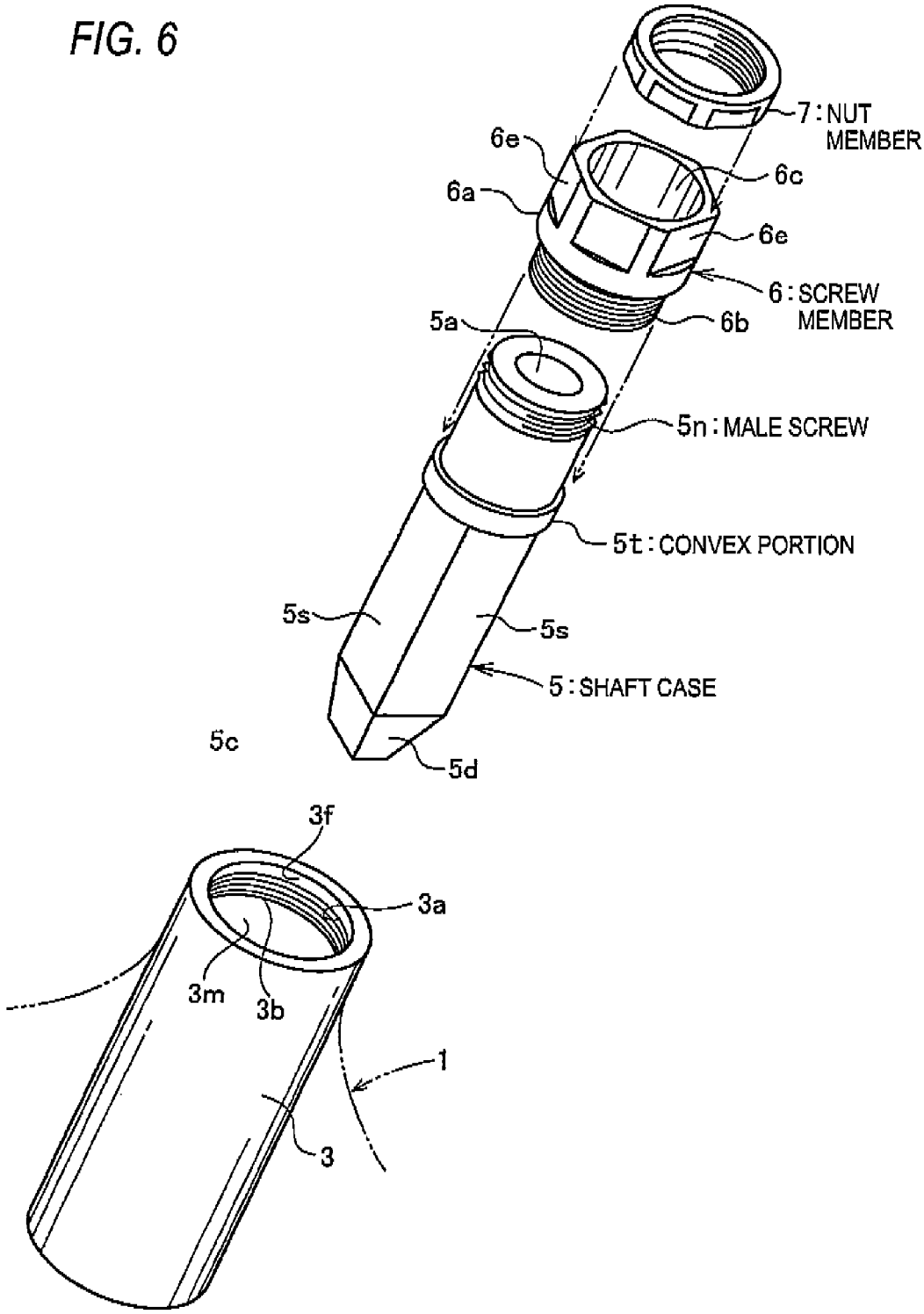
FIG. 6 is a perspective view of a hosel, a shaft case, and a screw member.
Figure 7A:
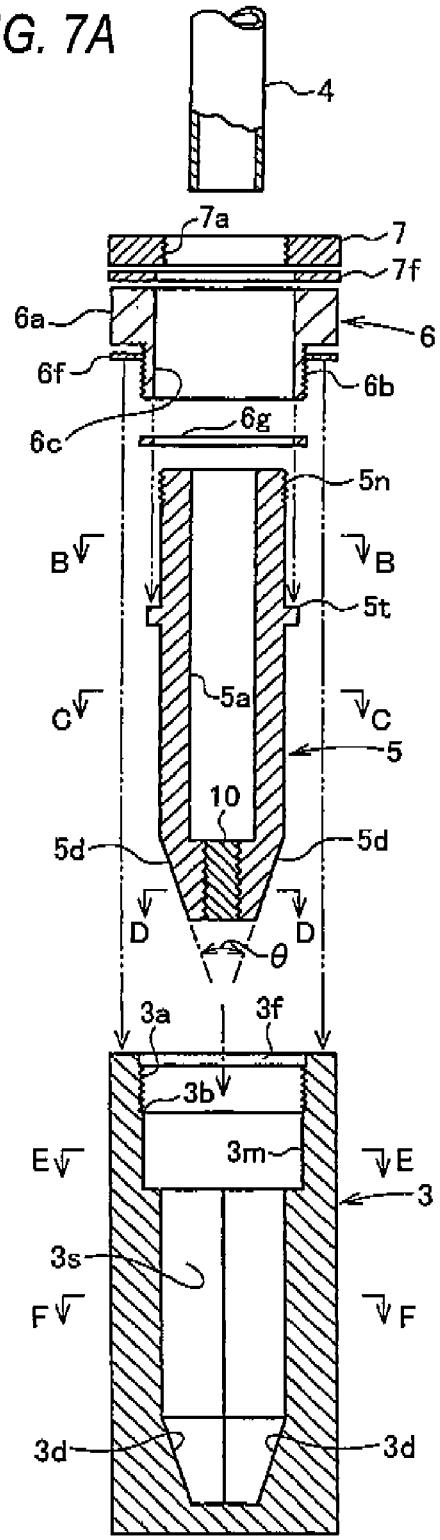
FIG. 7A is cross-sectional view of the hosel, the shaft case, and the screw member.
Figure 7B:
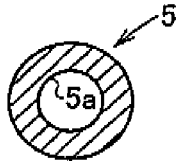
FIGS. 7B to 7F are cross-sectional views taken along B-B line to F-F line in FIG. 7A, respectively.
Figure 7C:
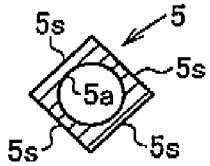
Figure 7D:
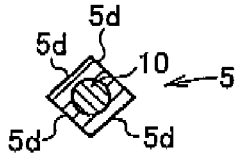
Figure 7E:
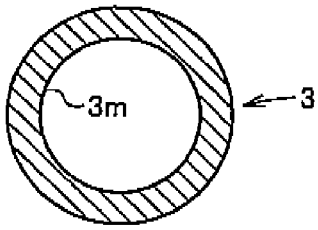
Figure 7F:
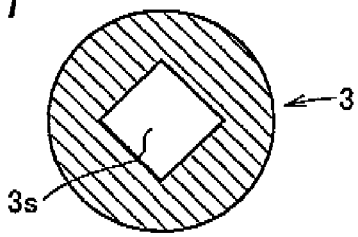
Figure 8:
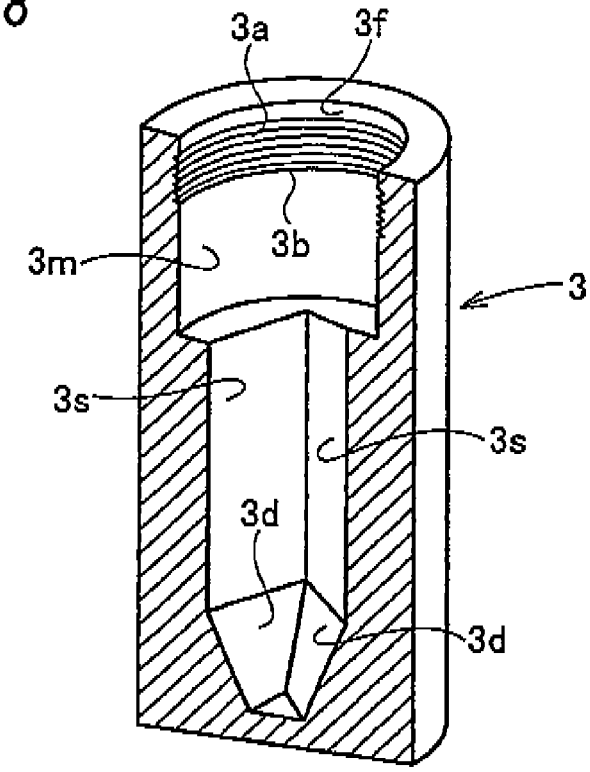
FIG. 8 is a sectional perspective view of the hosel.

A female screw 3*a* is provided in the hosel hole on the entrance side, that is, in the inner circumferential surface of the hosel on the upper end side. However, a male screw 3*a* is provided a position lower than the uppermost end of the hosel 3 by a predetermined distance (about 1 to 5 mm, particularly about 2 to 4 mm, for example), and the inner circumferential surface of the hosel between the uppermost end and the male screw 3*a* of the hosel 3 forms a smooth flat surface 3*f* with a cylindrical shape (FIGS. 6 to 8). In addition, a tapered surface with a tapered shape may be formed on the uppermost end of the flat surface 3*f*. In this embodiment, this female screw 3*a* is a reverse screw, and the male screw 6*b* of the screw member 6 which is screwed into this female screw 3*a* and will be described later is also a left-hand screw.

A stepped surface 3*b* is provided in the diameter-reduced direction subsequently to the female screw 3*a*, and to the side further to the inside than this stepped surface 3*b* forms a circular hole portion 3*m* with a cylindrical shape. In addition, the female screw 3*a* is formed by subjecting a hole surface with the same diameter as that of the circular hole portion 3*m* to screw cutting, the inner diameter of the female screw 3 portion is greater than that of the circular hole portion 3*m* by the amount corresponding to the screw-cut portion, and the stepped surface 3*b* is formed on the border between the male screw 3*a* and the circular hole portion 3*m*.

The side further to the inside (lower side) than this circular hole portion 3*m* forms a square hole portion 3*s*. Two pairs of slopes 3*d* which obliquely intersect with the axial center of the hosel 3 are provided on the side further to the inside than this square hole portion 3*s*, and the hole bottom portion has a truncated square pyramid shape. The slopes 3*d* and 3*d* facing each other are symmetrically positioned while interposing the axial center of the hosel 3. The distance between the slopes 3*d* and 3*d* facing each other, that is, the interval in the direction perpendicular to the axial center line of the hosel decreases as it approaches the lower end side of the hosel. The intersecting angle θ (FIG. 7(*a*)) between the slopes 3*d* and 3*d* facing each other preferably ranges from 10 to 30° and particularly from 15 to 20°.

As shown in FIGS. 6 and 7, the shaft case 5 is a substantially tube-shaped member in which the upper portion has a cylindrical shape and the lower portion has a square tube shape, and the shaft case 5 is provided with a hole 5*a* from the upper end side to the lower end side for inserting the shaft 4. The length of the shaft case 5 is preferably not less than 30 mm, from 40 to 60 mm, for example, and particularly from about 45 to 55 mm. It is preferable that the shaft case 5 protrudes from the hosel 3 by 10 to 30 mm, particularly by about 15 to 20 mm in the state of being inserted into and fixed to the hosel 3.

A female screw opening is provided so as to penetrate from the inside bottom surface of the hole 5*a* to the lower end surface of the shaft case 5, and a weight material 10 is screwed into this female screw opening.

The depth of the hole 5*a* preferably ranges from 20 to 50 mm, particularly from 25 to 40 mm.

A convex portion 5*t* is provided on the outer circumferential surface of the shaft case 5 in the middle of the direction of the axial center line of the tube (longitudinal direction). In this embodiment, the convex portion 5*t* has a flange shape which surrounds the shaft case 5. This convex portion 5*t* has a diameter which comes in contact with the stepped surface 3*b* from its upper side.

The side of the shaft case 5 further up than the convex portion 5*t* forms a cylindrical shape, and a male screw 5*n* is provided on the outer circumferential surface of its upper side. The part on to the side lower than the convex portion 5*t* forms a square tube portion 5*s*.

The distance from the upper end to the convex portion 5*t* of the shaft case 5 preferably ranges from 10 to 30 mm, particularly from about 15 to 20 mm.

Two pairs of slopes 5*c* are provided on the outer surface of the shaft case 5 on the lower end side so as to form a truncated square pyramid shape. The slopes 5*c* and 5*c* facing each other are symmetrically provided while interposing the axial center line of the shaft case 5. The distance between the slopes 5*c* and 5*c* facing each other, that is, the interval in the direction perpendicular to the axial center line of the shaft case 5 decreases as it approaches the lower end side of the shaft case. The intersecting angle between the slopes 5*c* and 5*c* facing each other is the same as the intersecting angle θ between the slopes 3*d* and 3*d* of the hosel 3. The size of the slope 5*c* of the shaft case 5 may be the same as that of the slope 3*d* of the hosel 3 and may be slightly smaller when an elastic body is interposed.

Although not shown in the drawings, a configuration is also applicable in which a chamfer with an angle of about 20 to 45° is formed in the inner circumferential edge of the shaft case 5 on the upper end side in order to make it easier to insert the shaft 4.

The screw member 6 has a substantially ring shape in which the lower half portion has a smaller diameter as compared with the upper half portion 6*a*, and a male screw 6*b* is carved on the outer circumferential surface of the lower half portion. A tool engaging portion 6*e* is provided on the outer circumferential surface of the upper half portion 6*a* on the upper end side and forms a nut shape.

The lower half portion of the screw member 6 has a diameter with which the male screw 6*b* is screwed into the female screw 3*a* of the hosel 3. The screw member 6 includes an opening 6*c* penetrating in the axial center line direction. The diameter of this opening 6*c* is very slightly larger than the diameter of the cylinder-shaped portion of the shaft case 5 further to the upper side than the convex portion 5*t*, and the screw member 6 is slidably fitted onto the portion of the shaft case 5 further up than the convex portion 5.

As shown in FIGS. 3 and 7, ring-shaped spacers (a thin spacer made of an elastic body such as rubber, elastomer, or the like) 6*f* and 6*g* are interposed between the lower end surface of the upper half portion 6*a* of the screw member 6 and the upper end surface of the hosel 3 and between the lower end surface of the lower half portion 6*b* and the upper surface of the convex portion 5*t*.

In this embodiment, a nut member 7 is provided on the upper side of the screw member 6. A female screw 7*a* into which the male screw 5*n* of the shaft case 5 is screwed (FIG. 7A) is provided on the inner circumferential surface of the nut member 7. The male screw 5*n* and the female screw 7*a* are proper screws.

As shown in FIGS. 3 and 7A to 7F, a thin spacer 7*f* made of an elastic body such as rubber, elastomer, or the like, plastic, or metal is interposed between the nut member 7 and the screw member 6. This spacer 7*f* has a flat ring shape and is provided with a cut portion extending from the inner circumferential edge to the outer circumferential edge at a portion in the circumferential direction. Since the spacer does not vibrate and is slidably fixed by providing this cut portion, it is possible to prevent the screw member 6 from being caught by the nut member 7 when the screw member 6 is rotated in the loosening direction and the nut member 7 is pressed upward, and to thereby smoothly rotate the screw member 6.

Figure 4:
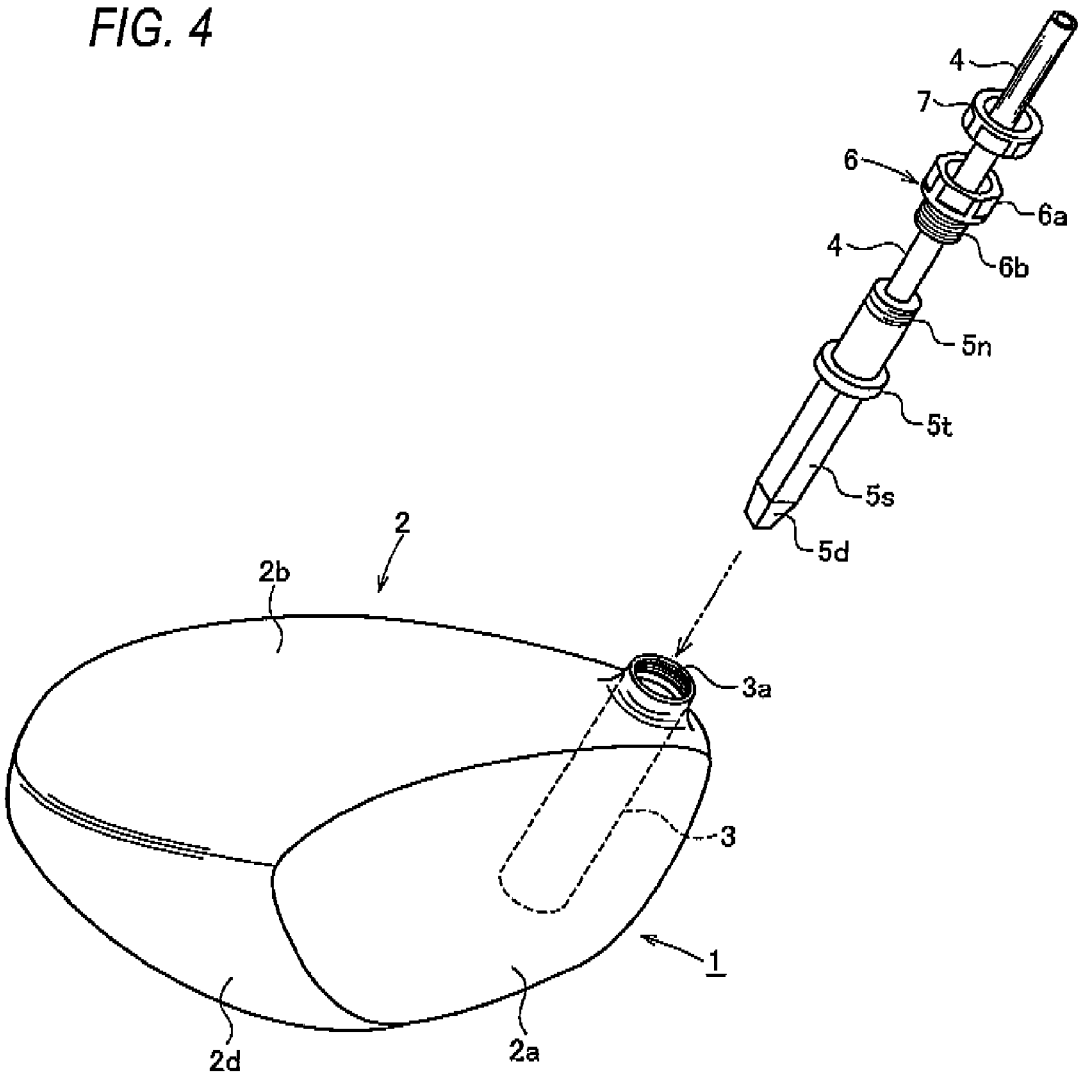
FIG. 4 is a perspective view showing methods of attaching and replacing a shaft.

When a golf club is assembled, the nut member 7 and the screw member 6 are fit from the leading end side of the shaft 4, and the shaft case 5 is bonded to the leading end of the shaft 4 with the use of adhesive as shown in FIG. 4. Preferably, the outer circumferential surface of the leading end portion of the shaft 4 is coated with this adhesive, and the shaft 4 is inserted up to the furthest portion of the hole 5*a* of the shaft case 5. As the adhesive, an epoxy adhesive or the like is preferably used. In addition, since the air within the hole 5*a* is removed if the weight material 10 is detached when the shaft 4 is inserted, the shaft 4 can be easily inserted.

The shaft case 5 in a shaft case and shaft connected body, in which the nut member 7 and the screw member 6 are fitted and inserted and the shaft case 5 is bonded as described above, is inserted into the hosel 3 of the head 1 as shown in FIG. 4.

Figure 5A:
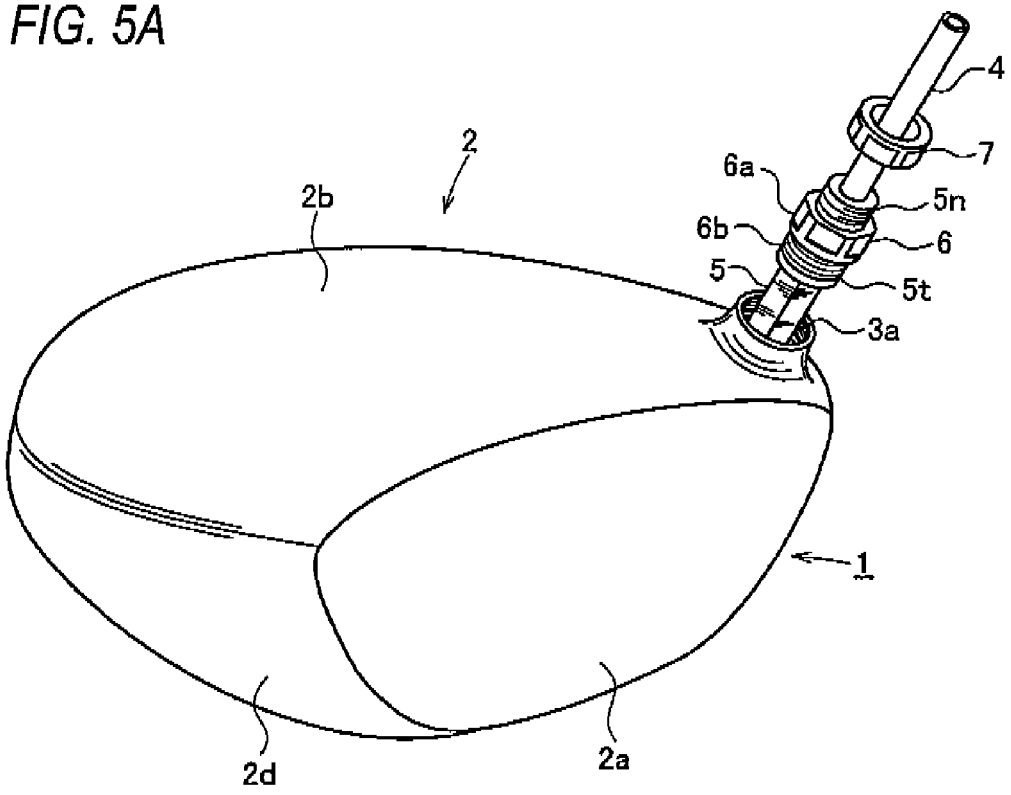
FIGS. 5A and 5B are perspective views showing methods of attaching and replacing the shaft.

As shown in FIG. 5A, the shaft case 5 is inserted into the hosel 3, the square tube portion 5*s* and the square hole portion 3*s* are engaged with each other, and the slope 5*c* and the slope 3*d* are superposed on each other.

Figure 5B:
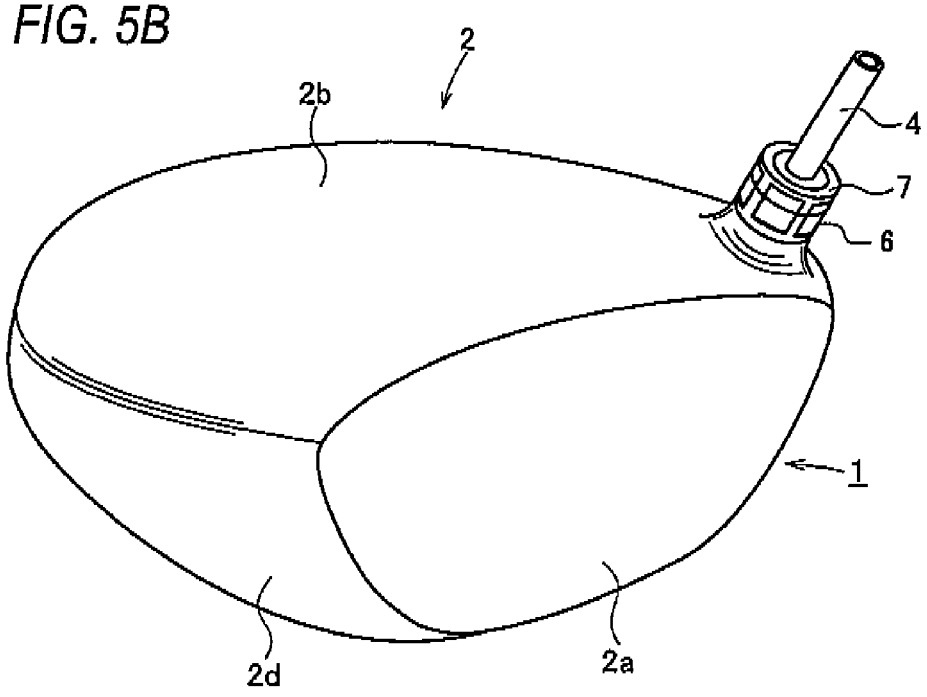

The convex portion 5*t* is engaged with the stepped surface 3*b*. Then, the male screw 6*b* of the screw member 6 is screwed into the female screw 3*a* of the hosel 3, and the nut member 7 is then screwed onto the male screw 5*a* of the shaft case 5 as shown in FIG. 5B.

At this time, since the flat portion 3*f* is provided on the upper side of the female screw 3*a*, the screw member can be easily screwed into the hosel 3 while the screw member 6 is rotated, after the lower end side of the screw member 6 is inserted to the flat portion 3*f* so as to cause the screw member 6 to be in the standing state.

Thus, the lower end surface of the screw member 6 presses the upper surface of the convex portion 5*t* of the shaft case 5, the slope 5*c* of the shaft case 5 is pressed onto the slope 3*d* of the hosel 3, and the shaft case 5 is fixed to the hosel 3 as shown in FIG. 3. The shaft case 5 and the shaft 4 are strongly adhered with the adhesive, and therefore, a golf club in which the shaft 4 and the head 1 are integrally provided is completed.

In this embodiment, the screw member 6 is fitted onto the shaft case 5 and screwed into the hosel 3, the nut member 7 is screwed into the outer circumference of the upper end of the shaft case 5, and the screw member 6 and the nut member 7 do not contact with the shaft 4 when rotated. Accordingly, it is possible to prevent the shaft 4 from being damaged.

When the shaft case 5 is pulled out from this golf club, the screw member 6 is rotated in the loosening direction while the nut member 7 is maintained in an attached state. Since the male screw 6*b* of this screw member 6 is screwed into the female screw 3*a* of the hosel 3, the screw member 6 moves upward (advances by screwing) and presses up the nut member 7 if the screw member 6 is rotated in the loosening direction. The nut member 7 is bonded to the shaft case 5, and therefore, the nut member 7 and the shaft case 5 integrally move upward when the nut member 7 is pressed up by the screw member 6. With such a configuration, the shaft case 5 can be easily detached since it moves to the upper direction in which the shaft case 5 is separated from the hosel 3.

According to this golf club, high strength and rigidity for the attachment of the shaft 4 and the shaft case 5 can be achieved since the shaft case 5 to which the shaft 4 is attached is inserted into the hosel 3 and fixed with the screw member 6. In addition, since the square tube portion 5*s* of the shaft case 5 is made to be engaged with the square hole portion 3*s* of the hosel 3 and the slopes 3*d* and 5*c* are engaged with each other, less slipping occurs, and the rotation of the shaft 4 about a direction around the axial center of the shaft is prevented. That is, high fixing rigidity of the shaft 4 in the torque direction can be achieved.

When the shaft of the golf club is to be replaced, the same shaft case as the above-mentioned shaft case 5 is bonded to a new shaft, with which the existing shaft is to be replaced, in advance with the adhesive. In addition, the nut member 7 and the screw member 6 are also attached to this shaft.

The screw member 6 of the existing golf club is detached, and the old shaft 4, the old shaft case 5, the nut member 7, and the screw member 6 are detached from the head 1 together. Subsequently, a new shaft with a shaft case, a top member, and a screw member (shaft case and shaft connected body) is inserted into the head 1 and fixed with the screw member 6 and the nut member 7.

As described above, it is possible to perform attachment and replacement of the shaft very easily and rapidly. Conventionally, it took several hours to about a day to replace the shaft since the hosel portion of the existing golf club was heated to destroy the composition of the adhesive hardener, the shaft was pulled out, and a new shaft was then bonded with adhesive. However, it is possible to replace the shaft in several minutes by attaching the shaft case 5 to the new shaft with adhesive in advance in the embodiment. Accordingly, it is possible to implement a usage style in which different shafts are sequentially attached to the same head main body for trial shots by preparing the shafts of various specifications, to each of which the shaft case is attached.

In addition, the shaft case 5 can be easily inserted into the hosel 3 since the leading end side of the shaft case 5 is made to have a tapered shape by providing two pairs of slopes 5*c*.

It is preferable that the hosel, the shaft case, and the screw member are made of metal, particularly, aluminum, titanium, or an alloy thereof. The nut member 7 is preferably made of aluminum or synthetic resin. The hosel 3 which has a separate body from the head 1 is preferably made of a material with a specific gravity equivalent to or lower than that of the head main body, and titanium alloy, aluminum, aluminum alloy, magnesium alloy, FRP, synthetic resin or the like may be used, for example.

Although the material of the head is not particularly limited, titanium alloy, aluminum alloy, stainless, or the like may be used, for example, in the case of a wood type golf club head.

In the above embodiment, since the circular hole portion 3*m* is provided on the side further to the inside (lower side) than the stepped surface 3*b* of the hosel 3, and a gap portion is formed between the inner circumferential surface of this circular hole portion 3*m* and the shaft case 5, the weight of the hosel 3 is lightened by the amount corresponding to the gap portion. The inner diameter of the circular hole portion 3*m* is preferably longer than the outer diameter of the cylindrical shape portion of the upper portion of the shaft case 5 by 0.2 to 5.0 mm, particularly by 1.0 to 3.0 mm. The length (depth) of the circular hole portion 3*m* preferably ranges from 1 to 8 mm, and particularly from 3 to 6 mm.

Figure 9:
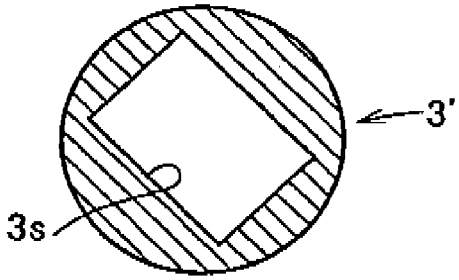
FIG. 9 is a cross-sectional view of the hosel.
Figure 10:
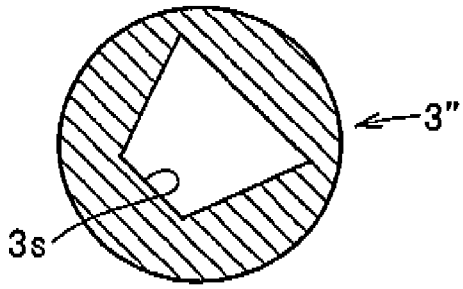
FIG. 10 is a cross-sectional view of the hosel.

Although the square hole portion 3*s* and the square tube portion 5*s* with quadrate shapes are provided in the hosel 3 and the shaft case 5 in the above embodiment, the cross-section may have a rectangular shape, a trapezoidal shape, or the like or may have a non-circular shape other than the square shape. Examples of the non-circular cross-section shapes include a polygonal shape such as a hexagonal shape or the like, a star shape, a gear shape, an oval shape, a shape obtained by cutting a part of a circle in the chord direction, and the like. FIG. 9 is a cross-sectional view of the hosel 3' including a square hole portion 3*s* with a rectangular cross-sectional shape, and FIG. 10 is a cross-sectional view of the hosel 3" including the square hole portion 3*s* with a trapezoidal cross-section, each of which shows the cross-section of the same part as that shown in FIG. 7F.

In addition, a grip to be attached to the shaft 4, which has a non-circular cross-section, is used in some cases. For example, the lower side surface in the outer circumferential surface of the grip, which directs the ground in the address state, is made to have a shape protruding as compared with the other surfaces. In such a case, the shaft can be attached to the head such that the grip protruding portion reliably directs the ground side by setting the direction of the shaft case 5 in the circumferential direction corresponding to the grip protruding portion when the shaft case 5 is attached to the shaft 4.

Figure 11:
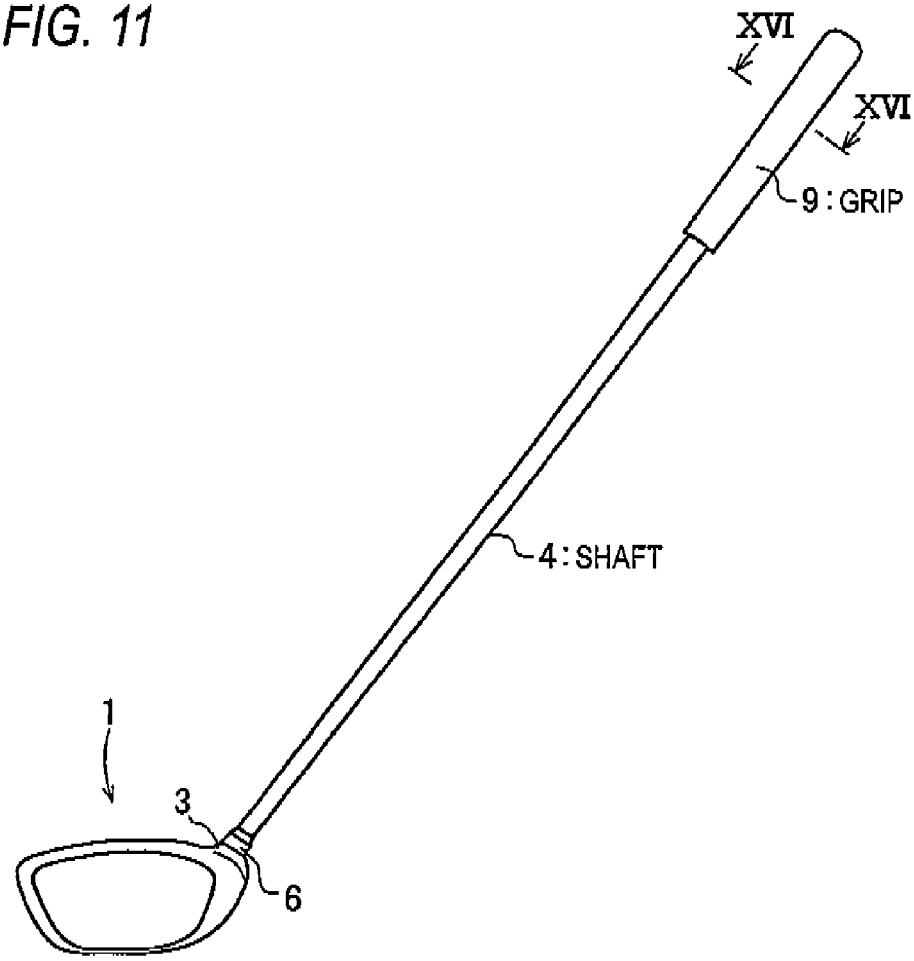
FIG. 11 is a front view of a golf club according to an embodiment.

An example of such a grip with a non-true-circular cross-section will be shown in FIGS. 12 to 16, and the golf club in which this grip is attached to the golf club head 1 will be shown in FIG. 11.

Figure 12:
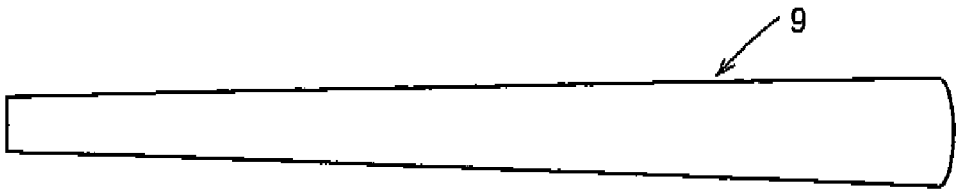
FIG. 12 is a side view of a grip.
Figure 13:
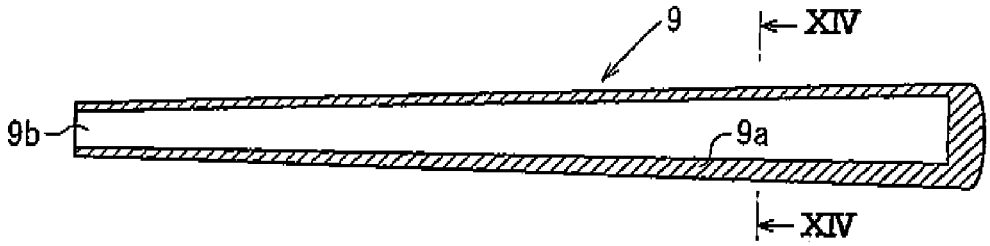
FIG. 13 is a cross-sectional view of the grip.
Figure 14:
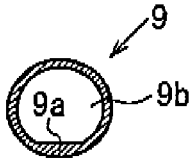
FIG. 14 is a cross-sectional view taken along XIV-XIV line in FIG. 13.
Figure 15:
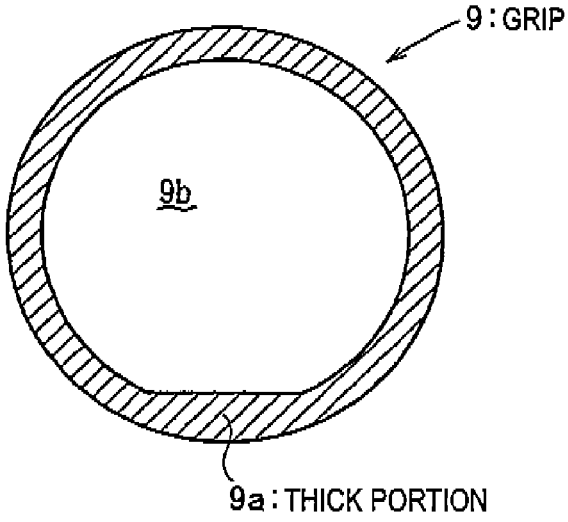
FIG. 15 is an enlarged view of FIG. 14.
Figure 16:
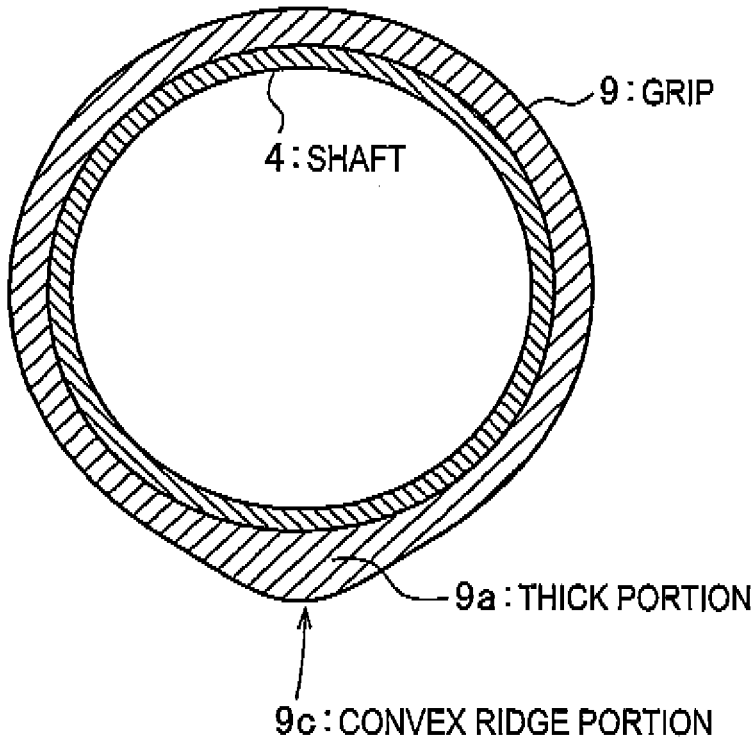
FIG. 16 is a cross-sectional view taken along XVI-XVI line in FIG. 15.

In addition, FIG. 12 is a side view of the grip 9, FIG. 13 is a vertical cross-sectional view of the grip 9 in the longitudinal direction, FIG. 14 is a cross-sectional view taken along XIV-XIV line in FIG. 13, FIG. 15 is an enlarged view of FIG. 14, and FIG. 16 is an enlarged cross-sectional view taken along XVI-XVI line in FIG. 11.

As shown in FIG. 11, the leading end of the shaft 4 is inserted into the hosel of the head 1 and fixed with the adhesive.

The grip 9 has a substantially tube shape including an inserting hole 9*b* for the shaft 4 and is made of rubber or the like. This grip 9 is provided with a thick portion 9*a* in a part (the lower side in FIG. 11) in its circumferential direction. This thick portion extends in the longitudinal direction of the grip 9. This thick portion 9*a* is provided such that the sectional shape of the inner circumferential surface of the grip 9 (sectional shape in the direction perpendicular to the longitudinal direction of the grip 9) becomes a chord shape. When the shaft 4 is inserted into this grip 9, the thick portion 9*a* is pressed outward from the inner side, the outer circumference protrudes, and the convex ridge portion 9*c* is formed as shown in FIG. 16. This convex ridge portion 9*c* extends in the longitudinal direction of the grip 9 (in the longitudinal direction of the shaft 4). The shaft case and shaft connected body is configured by attaching the shaft case 5 to the shaft 4 such that this convex ridge portion 9*c* is positioned so as to direct the lower side, that is, the side facing the ground when the golf club is in the address state. With such a configuration, the convex ridge portion 9*c* is always correctly positioned on the ground side in the address state even if any shaft case and shaft connected body is attached to the head 1. It is possible to correctly position the convex ridge portion 9*c* on the ground side when the hosel and the shaft case with the sectional shapes shown in FIGS. 9 and 10, particularly in FIG. 10 are used.

Although the golf club head is a wood type in the above embodiment, the present invention can also be applied to any type of golf club head including a utility type, an iron type, a putter, and the like.

In the case of a hollow type golf club head shown in the drawings, the weight on the heel side is heavier as compared with a general golf club head since the hosel 3, the hosel placement portion 2*g*, the shaft case 5, and the screw member 6 are provided. Accordingly, it is preferable to configure the toe side or the back portion to be thicker or provide a weight on the toe side in order to keep a good balance for the golf club head.

What is claimed is:

1. A golf club comprising:

a shaft; a head including a hosel formed with a hosel hole;

a shaft case with a substantially tube shape being bonded to a leading end of the shaft, the shaft case being inserted into the hosel hole, the shaft case being fixed to the hosel by a ring-shaped screw member fitted onto an upper portion of the shaft case and detachably screwed into a female screw in an inner circumferential surface of the hosel hole;

a male screw provided on an outer circumferential surface of the upper end portion of the shaft case; and a nut member screwed onto the male screw, wherein an outer side surface of a lower side part of the shaft case and a lower side part of the hosel hole have non-circular cross-section shapes.

2. The golf club according to claim 1, wherein the non-circular cross-section shapes are square shapes.

3. The golf club according to claim 1, wherein the female screw of the hosel hole is provided further to a lower part than the upper end of the hosel hole by a predetermined distance.

4. The golf club according to claim 1, further comprising:

a ring-shaped spacer interposed between the nut member and the screw member, the ring-shaped spacer being provided with a cut portion extending from the inner circumference to the outer circumference.

5. A golf club comprising:

a shaft;

a head including a hosel formed with a hosel hole;

a shaft case with a substantially tube shape being bonded to a leading end of the shaft, the shaft case being inserted into the hosel hole, the shaft case being fixed to the hosel by a ring-shaped screw member fitted onto an upper portion of the shaft case and detachably screwed into a female screw in an inner circumferential surface of the hosel hole, wherein:

a leading end side of the shaft case has a tapered shape;

an outer side surface of the shaft case and a lower side part of the hosel hole have slopes and non-circular cross-section shapes;

a male screw provided on an, outer circumferential surface of the upper end portion of the shaft case;

a nut member screwed onto the male screw; and a ring-shaped spacer interposed between the nut member and the screw member, the ring-shaped spacer being provided with a cut portion extending from the inner circumference to the outer circumference.

6. The gold club according to claim 5, wherein the female screw is provided on an inner circumferential surface of the hosel on an upper end side such that the inner circumferential surface of the hosel between the uppermost end and the male screw forms a smooth flat surface with a cylindrical shape.

7. The gold club according to claim 5, the male screw is provided a position lower than an uppermost end of the hosel by a predetermined distance ranging from 1 mm to 5 mm.

8. The gold club according to claim 5, wherein the hosel comprises a stepped surface extending radially inward at a portion of the hosel hole below the female screw 3*a*, and a side of the hosel further to the inside than the stepped surface forms a circular hole portion with a cylindrical shape, and wherein the female screw 3*a* is formed by subjecting a hole surface with the same diameter as that of the circular hole portion to screw cutting, the inner diameter of the female screw portion is greater than that of the circular hole portion by the amount corresponding to the screw-cut portion, and the stepped surface is formed on the border between the male screw and the circular hole portion.

9. The gold club according to claim 5, wherein the leading end side of the shaft case is made to have a tapered shape by providing four inclined surfaces.

* * * * *